US010953308B1

(12) United States Patent
Blazhko et al.

(10) Patent No.: US 10,953,308 B1
(45) **Date of Patent: *Mar. 23, 2021**

(54) APPARATUS FOR HAND PROTECTION AND METHOD THEREOF

(71) Applicant: WOD Solutions Inc, Feasterville, PA (US)

(72) Inventors: Eugene Blazhko, Feasterville, PA (US); Aleksandr Laznik, Warwick, PA (US)

(73) Assignee: WOD Solutions Inc., Feasterville, PA (US)

( * ) Notice: Subject to any disclaimer, the term of this patent is extended or adjusted under 35 U.S.C. 154(b) by 109 days.

This patent is subject to a terminal disclaimer.

(21) Appl. No.: 16/369,315

(22) Filed: Mar. 29, 2019

Related U.S. Application Data

(63) Continuation of application No. 15/489,121, filed on Apr. 17, 2017, now Pat. No. 10,245,497.

(60) Provisional application No. 62/324,651, filed on Apr. 19, 2016.

(51) Int. Cl.

| | |
|---|---|
| ***A63B 71/14*** | (2006.01) |
| ***A41D 13/08*** | (2006.01) |
| *A63B 71/00* | (2006.01) |

(52) U.S. Cl.
CPC ..... *A63B 71/14* (2013.01); *A41D 13/082* (2013.01); *A63B 2209/10* (2013.01); *A63B 2244/09* (2013.01)

(58) Field of Classification Search
CPC . B32B 7/12; B32B 2405/00; B32B 2307/744; B32B 2307/748; B32B 7/06; B32B 5/024; B32B 3/085; B32B 3/30; B32B 2307/51; A61L 15/42; A61F 13/023; A61F 13/02; A61F 13/0246; A61F 2013/00919; A61F 5/40; A61F 13/105; A61F 13/4702
See application file for complete search history.

(56) References Cited

U.S. PATENT DOCUMENTS

| | | | | |
|---|---|---|---|---|
| 3,734,097 A * | 5/1973 | Zaffaroni | ..... | A61F 9/0017 424/448 |
| 4,245,630 A * | 1/1981 | Lloyd | ..... | A61F 13/0203 428/167 |
| 4,567,091 A * | 1/1986 | Spector | ..... | A63B 49/08 428/222 |
| 6,049,022 A * | 4/2000 | Tseng | ..... | A63B 71/14 602/41 |

(Continued)

OTHER PUBLICATIONS

Rocktape UK (2013). Screenshot from video at :31, :38, 1:06, and 1:39. Rocktape—Palm tape (Crossfit). Youtube. Published at https://youtu.be/tldCGSi3Hec on May 16, 2013.

*Primary Examiner* — Robert H Muromoto, Jr.
(74) *Attorney, Agent, or Firm* — Kaplan Breyer Schwarz, LLP

(57) ABSTRACT

An apparatus for hand protection includes a flexible sheet that extends from a first end to a second end of the flexible sheet along a length thereof. Adhesive material is located on one side of the flexible sheet. A backing layer is on the adhesive material. The flexible sheet includes at least one finger opening closer to the first end than to the second end. A method enables a flexible sheet with adhesive material thereon to be applied to a person's hands. Fingers are inserted through one or more finger openings. The backing layer is removed. The flexible sheet is adhered to the person's hand.

14 Claims, 9 Drawing Sheets

(56) References Cited

U.S. PATENT DOCUMENTS 10,245,497 B2 * 4/2019 Blazhko ..... A63B 71/14
2001/0009828 A1 * 7/2001 Himmelsbach ..... A61L 15/58 442/35
2003/0070669 A1 * 4/2003 Beville ..... F41B 5/10 124/88
2003/0159250 A1 * 8/2003 Ruana ..... A62B 3/00 16/431
2003/0182760 A1 * 10/2003 Hagen ..... B65D 33/10 16/114.1
2003/0225356 A1 * 12/2003 Kulichikhin ..... A61L 15/585 602/54
2004/0081801 A1 * 4/2004 Albert ..... A41D 19/01558 428/159
2005/0228331 A1 * 10/2005 Tseng ..... A61F 13/105 602/58
2007/0037500 A1 * 2/2007 Minick ..... B24D 11/001 451/533
2007/0051376 A1 * 3/2007 Kulichikhin ..... A61L 15/585 128/894
2007/0173752 A1 * 7/2007 Schonfeldt ..... A61F 15/001 602/57
2008/0102240 A1 * 5/2008 Serra ..... C09J 133/14 428/41.8
2008/0319411 A1 * 12/2008 Mortensen ..... A61F 13/4702 604/387
2010/0189947 A1 * 7/2010 Serra ..... C09J 133/14 428/40.1
2010/0298747 A1 * 11/2010 Quinn ..... A61F 5/40 602/1
2011/0040258 A1 * 2/2011 Robison ..... A61M 25/02 604/179
2011/0293681 A1 * 12/2011 Berlin ..... A61L 15/46 424/405
2012/0094051 A1 * 4/2012 Chang ..... A63C 17/0006 428/41.8
2012/0231199 A1 * 9/2012 Bartusiak ..... B32B 38/06 428/43
2012/0295054 A1 * 11/2012 Hope ..... A61L 15/58 428/41.8
2013/0025779 A1 * 1/2013 Bartusiak ..... C09J 107/00 156/280
2014/0079900 A1 * 3/2014 Ramirez ..... C09J 7/21 428/41.8
2015/0247066 A1 * 9/2015 Ramirez ..... C09J 7/21 602/1
2017/0246520 A1 * 8/2017 Pang ..... B25D 17/043

* cited by examiner

APPARATUS FOR HAND PROTECTION AND METHOD THEREOF

This application is a Continuation of U.S. Ser. No. 15/489,121 (pending) which claims priority under 35 USC § 119 to U.S. Provisional Application 62/324,651 filed Apr. 19, 2016, both of which are hereby incorporated by reference in their entireties.

FIELD OF THE INVENTION

The present invention relates to hand protection and more particularly to hand protection for athletic activities. In particular, an apparatus and method thereof are described that enables hands to be protected with a protective material prior to athletic activities.

BACKGROUND OF THE INVENTION

Exercise is very important for good physical health. One form of exercise is to perform functional movements at high intensity. An example of this type of exercise is practiced under the trademark CROSSFIT. While many CROSSFIT exercises can be beneficial in terms of increased strength and improved cardiac health, some of these exercises may result in injury to a person's hands. An example of such an exercise is a kipping pullup, a type of pullup with horizontal momentum. Because the exercise causes a person's hands to move while they are grasping the bar, the possibility of torn skin is present. For example, if a person has developed callouses on their hands, the motion of a person's hands as they perform kipping pullups may cause the callouses to tear, resulting in dead skin and live skin being torn. Bleeding may eventually ensue. The person with the hand injuries may then be unable to resume exercise for several weeks until their hands have had a chance to heal.

Pull-ups, muscle-ups, "toes-to-bar," and Kettlebell swings are other examples of exercises that have the potential to injure a person's hands. Again, skin and/or callouses may rip, resulting in bleeding.

Weightlifting is another form of exercise that may result in hand injuries. Weightlifting is performed using a cylindrical rod, often referred to as a bar, to which is attached a plurality of weighted objects, often referred to as weights. An individual lifts the bar with the attached weights for a variety of different purposes. If the bar with the attached weights is being used for exercise, then the bar and the weights may be used in order to grow muscles, improve muscle tone, perform cardiovascular exercises, etc. In such scenarios, the bar in the weights may be lifted a plurality of times in order achieve some or all of the above objectives. Over a period of time, the number (and and/or amount) of weights attached to the bar can be increased in order to make exercise more challenging.

If a bar with a attached weights is being used in a competitive environment, various athletes are observed as they lift bars with attached weights to see which athlete is able to lift the heaviest combination of the bar and the weights. The athlete that lifts the heaviest bar/weights combination using a specified movement may then designated the winner of the competition.

Bars typically include knurling. Knurling is typically two sets of diagonal lines, with each set going in opposite direction. In this manner, thousands and thousands of tiny diamonds are formed. Knurling adds additional grip to the bar. In this manner, it is easier to hold onto the bar, particularly when extremely heavy weights are being lifted.

Knurling, however, has different levels of aggressiveness depending upon the width of the grooves and depth of the grooves caused by the knurling.

The use of gloves may protect an individual's hands during exercise, but there are disadvantages in using gloves as well.

With regard to weightlifting, for example, one school of thought believes that a bar should be lifted using gloves. Using gloves may make lifting more comfortable. Gloves may also play a desirable role in protecting the hands of the person lifting the weights. While lifting weights without gloves will cause hands develop calluses, over time, the calluses can be torn off, thus ripping off not only dead skin but live skin as well. Such a person may have bleeding hands, and then exercise may need to be halted for several weeks until the hands heal. This can be very inconvenient. Thus, there are some weightlifters (and/or weightlifting coaches) who believe that gloves should be worn during weightlifting. Another school of thought believes that gloves should not be used during lifting. One reason that gloves may be frowned upon is that gloves add extra diameter to the bar. As a result, the bar can be more difficult to hold, and difficulty holding the bar can interfere with the ability to manipulate the bar either during exercise or during competition. Furthermore, in professional weightlifting, men use a 28 mm bar while women use a 25 mm bar. If a woman were to use gloves in combination with a 25 mm bar, the resulting size would be greater than the men's bar, thus negating the advantages of the narrower bar. Furthermore, the use of gloves creates an intermediary between a person's hands and the bar. This can result in a loss of force transfer. As a result, men and/or women that are lifting weights may frown upon the use of gloves. Without the use of gloves, again, there is a risk of damaging hands, as skin and/or callouses rip, resulting in bleeding and pain.

With kipping and kettlebells, it is important for a person who is exercising to have a firm grasp. Gloves, however, would interfere with the ability of a person to grasp, and thus may not be desirable to engage in those forms of exercise.

Other types of gripping devices may be used during sports and exercise to prevent hands from ripping. Many of these devices have the problem of being either too bulky, which does not allow a good grip on the bar, and/or poor fit, which causes reduced grip strength, slipping and frustration.

As a further alternative, some athletes may use tape in order to protect their hands. In this manner, tape is applied to the hands of the person exercising and then the person grasps with taped hands. Such taping may be time-consuming, may not be applied correctly, may easily fall off, or may have areas with bumps or unevenness that may interfere with the ability to efficiently lift the bar.

SUMMARY OF THE INVENTION

An apparatus is for hand protection. The apparatus includes a flexible sheet that extends from a first end to a second end of the flexible sheet along a length thereof. Adhesive material is located on one side of the flexible sheet. A backing layer is on the adhesive material. The flexible sheet includes at least one finger opening closer to the first end than to the second end. The flexible sheet also includes a separation extending from the second end towards the first end. The separation separates the second end into a plurality of anchors. A method enables a flexible sheet with adhesive material thereon to be applied to a person's hands. Fingers are inserted through one or more finger openings. The backing layer is removed. The flexible sheet, including anchors formed by a separation extending from an end of the flexible sheet, are adhered around the person's hand.

DETAILED DESCRIPTION

Figure 1:
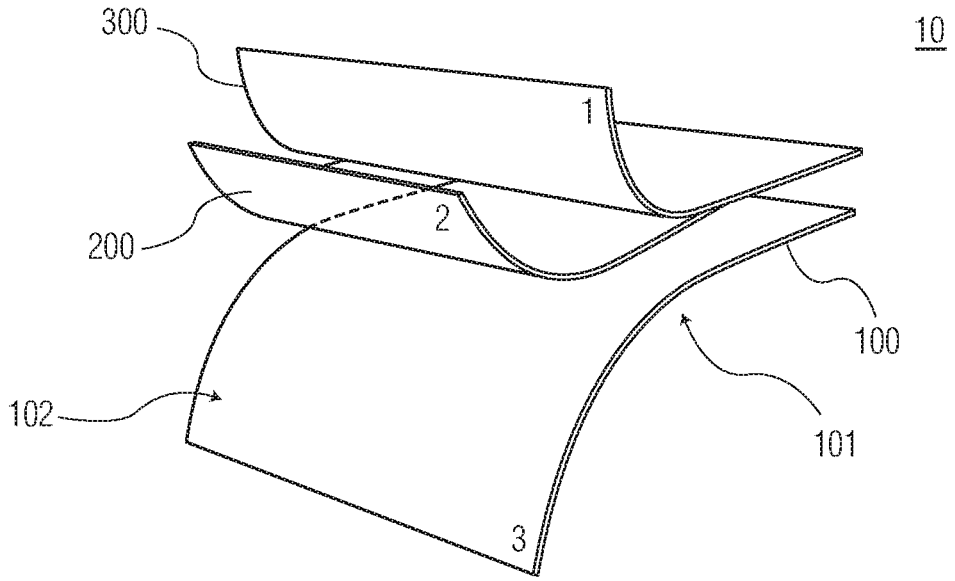
FIG. 1 is a perspective exploded drawing of a hands protection apparatus in accordance with an exemplary embodiment of the present invention.

FIG. 1 is a perspective view of a hand protection apparatus 10 in accordance with an exemplary embodiment of the present invention. Hand protection apparatus 10 includes flexible sheet 100, adhesive material 200 and backing layer 300. Flexible sheet 100 is a material that is able to bend. In one exemplary embodiment of the present invention, flexible sheet 100 is also capable of stretching. Flexible sheet 100 may be comprised of a woven material such as cloth. Various materials may be suitable for flexible sheet 100 including cotton, polyester, cotton polyester blends, other man-made materials including nylon, resin-based materials including plastics, etc. Flexible sheet 100 may be a woven material or a non-woven material.

FIG. 1 illustrates adhesive material 200 with a sheet-like appearance. This sheet-like appearance is, however, merely exemplary. In one exemplary embodiment, adhesive material 200 is uniformly applied to flexible sheet 100. In another exemplary embodiment, adhesive material 200 is applied to flexible sheet 100, not as a continuous coating but as a plurality of individual adhesive deposits separated by spaces without adhesive. Flexible sheet 100 includes flexible sheet top 101 and flexible sheet bottom 102. Adhesive material 200 is applied to flexible sheet bottom 102.

In order to manufacture hand protection apparatus 10 for retail sale, backing layer 300 is placed on top of adhesive material 200 so that adhesive material 200 is not exposed prior to hand protection apparatus 10 being applied to a person's hands. Backing layer 300 is comprised of a material that can easily be peeled away from adhesive material 200. The attractive strength between adhesive material 200 and flexible sheet 100 is desirably greater than the attractive strength between adhesive material 200 and backing layer 300. In this manner, hand protection apparatus 10 can be packaged and shipped for retail sale, and backing layer 300 can be removed during the process of adhering hand protection apparatus 10 to a person's hand.

In a further exemplary embodiment of the present invention, hand protection apparatus 10 is packaged and shipped as a plurality of hand protection apparatus. In one exemplary embodiment, the plurality of hand protection apparatus as shipped as alternating layers (i.e. flexible sheet 100, adhesive material 200, flexible sheet 100, adhesive material 200, etc.). In this exemplary embodiment, there may be two (or more) hand protection apparatus 10, one below the other, and the lower flexible sheet 100 may play the role of backing layer 300 for the upper hand protection apparatus 10.

Figure 2A:
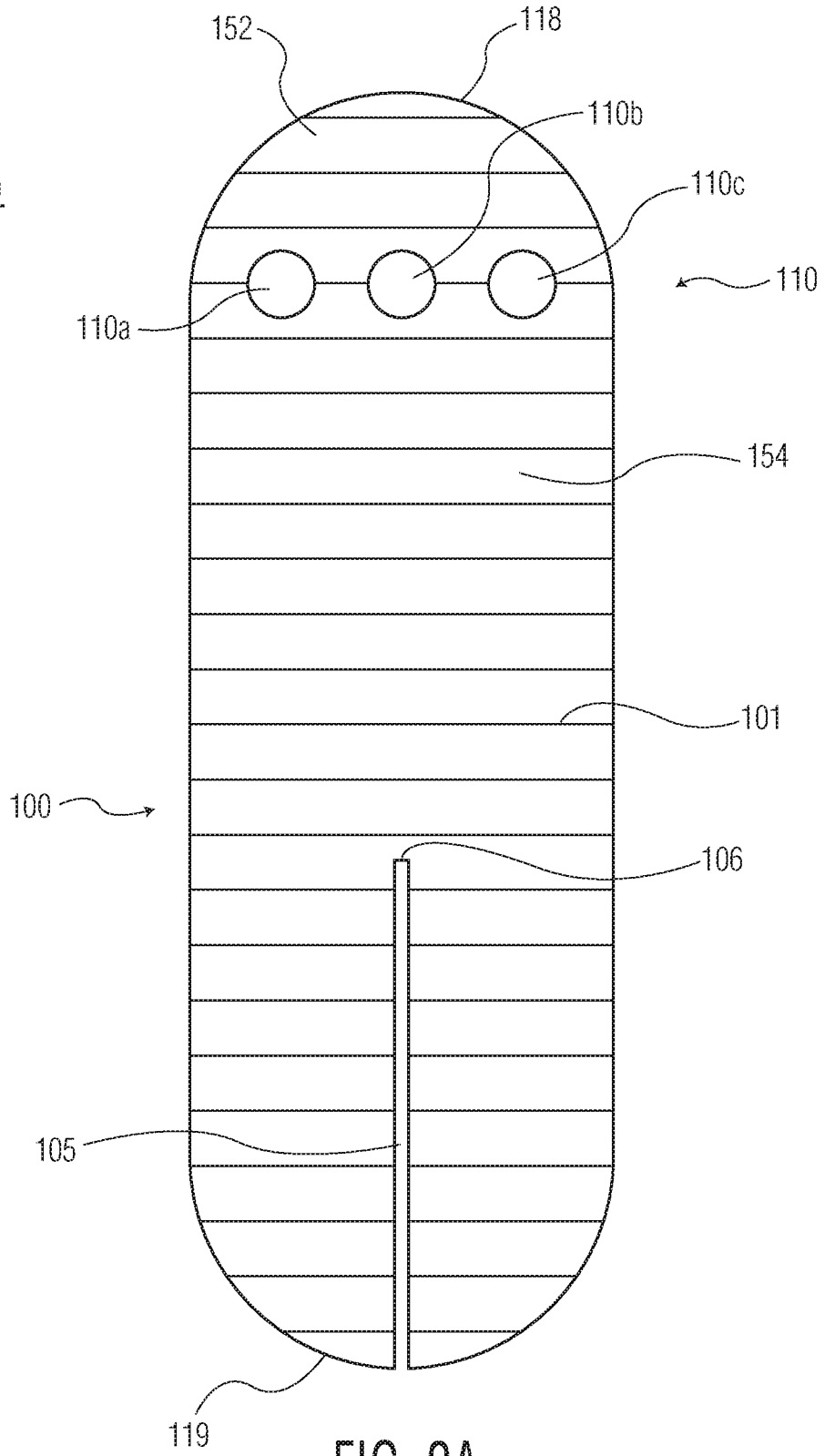
FIG. 2A is a top view of a hand protection apparatus in accordance with an exemplary embodiment of the present invention.

FIG. 2A illustrates a top view of hand protection apparatus 10 in accordance with an exemplary embodiment of the present invention. In FIG. 2A, flexible sheet top 101 is shown. The horizontal lines that appear in the figure are optional and may be replaced with other designs and/or colors, or may exclude designs and/or have a neutral color.

Flexible sheet 100 includes first end 118 and second end 119. In one exemplary embodiment of the present invention, the length of flexible sheet 100 extends from first end 118 to second end 119. In this exemplary embodiment, the length of flexible sheet 100 is greater than its width.

Separation 105 is formed in flexible sheet 100 and extends from second end 119 towards first end 118 along the length of flexible sheet 100. Separation 105 can extend along various fractional amounts of the length of flexible sheet 100 including one quarter of the length, one third of the length, one half of the length, etc. Separation 105 may be, for example, a slit that is formed in flexible sheet 100.

Flexible sheet 100 also includes one or more finger openings 110. Exemplary finger openings 110 may include finger openings 110A, B, C. First end portion 152 of flexible sheet 100 is between one or more finger openings 110 and first end 118. Middle portion 154 of flexible sheet 100 is between one or more finger openings 110 and termination point 106 of separation 105. One or more finger openings 110 can include various sizes. In one exemplary embodiment, one or more finger openings 110 are each of sufficient size so that three discrete openings can be formed across the width of flexible sheet 100. In another exemplary embodiment, one or more finger openings 110 are standard ring size such as size 5 to size 14. In a further exemplary embodiment, flexible sheet 100 is an elastic material so that finger openings 110 can accommodate a plurality of different size fingers regardless of the size of finger openings 110 before fingers are inserted therein. Adhesive material 200 and backing layer 300 are not shown in FIG. 2A, because they are under flexible sheet 100 in the orientation shown in FIG. 2A.

Figure 2B:
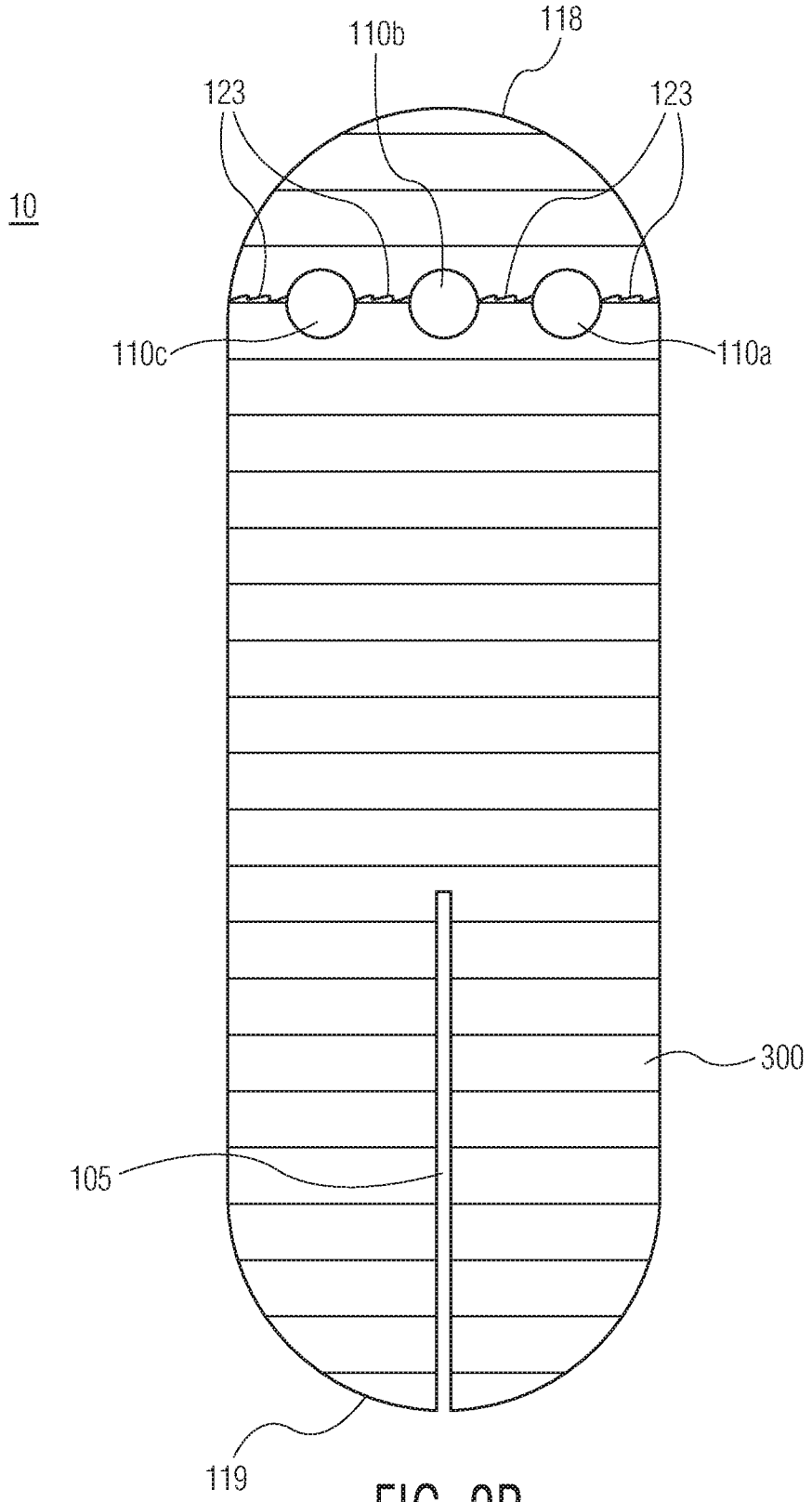
FIG. 2B is a bottom view of a hand protection apparatus in accordance with an exemplary embodiment of the present invention.

FIG. 2B illustrates the underside of hand protection apparatus 10 shown in FIG. 2A. Again, the illustrated horizontal lines are merely exemplary. In particular, in the view shown in FIG. 2B, backing layer 300 is shown. Thus, while finger openings 110A, B, C appear from left to right in FIG. 2A, finger openings 110A, B, C appear from right to left in FIG. 2B.

Finger openings 110A,B,C appear in FIG. 2B because there are openings leading to finger openings 110A,B,C in backing layer 300. The openings in backing layer 300 are optional.

Separation 105 appears in FIG. 2B because there is a corresponding separation in backing layer 300 but the corresponding separation is optional.

FIG. 2B illustrates separation 105 extending into backing layer 300 but this is optional. To clarify, although separation 105 is found in flexible sheet 100, separation 105 may or may not extend to backing layer 300.

FIG. 2B also illustrates tears 123 that are formed in backing layer 300. Tears 123 are desirable in order to attach hand protection apparatus 10 to a person's hands. Tears 123 may be formed, for example, by the person attaching hand protection apparatus 10 to their hand just prior to the attachment process. Alternatively, tears 123 can be formed as part of the manufacturing process of hand protection apparatus 10 so that hand protection apparatus 10 is shipped to the person who plans to use hand protection apparatus 10—with tears 123 already in place.

Figure 3:
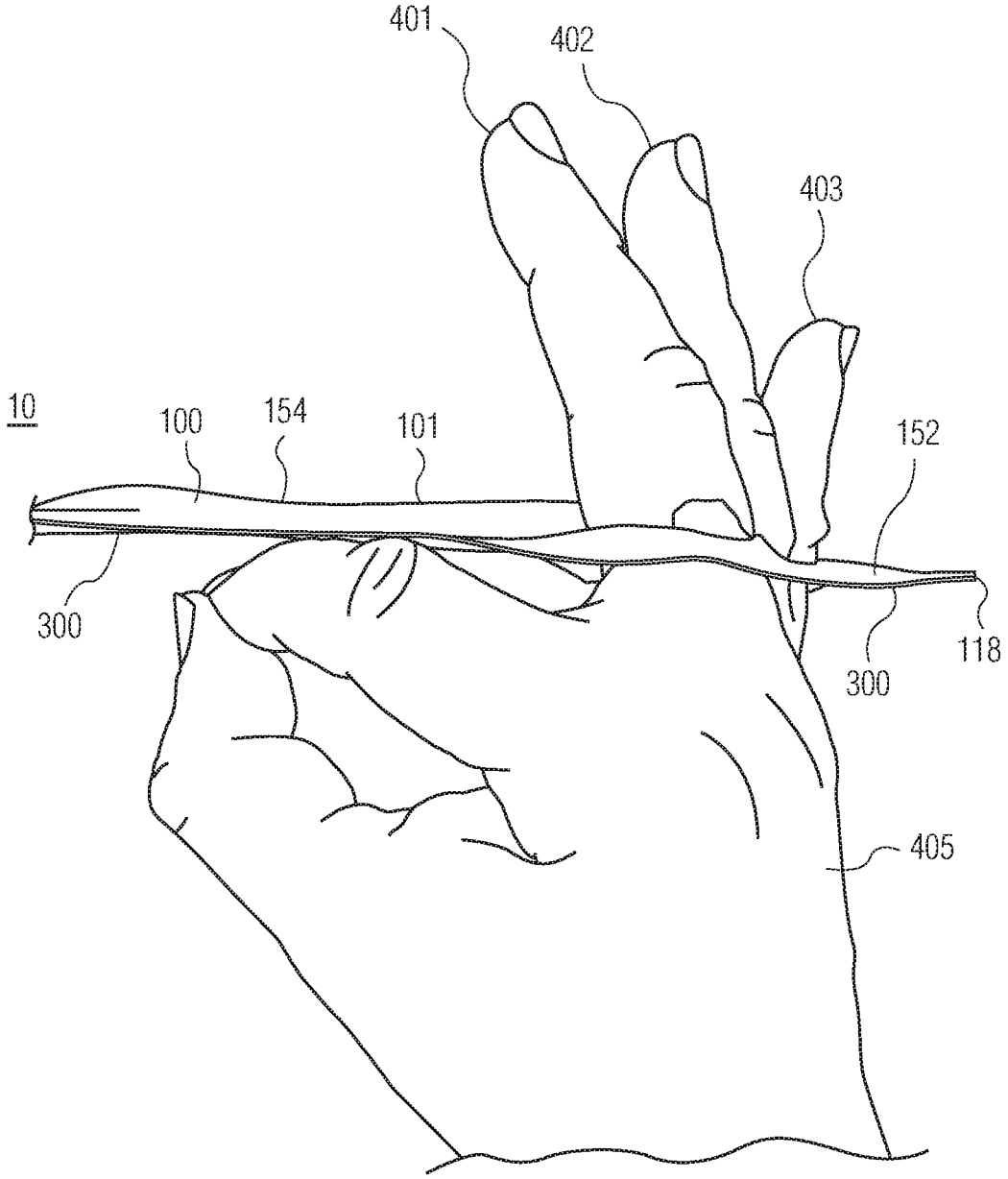
FIG. 3 is a perspective drawing that illustrates one exemplary step in an exemplary process for applying a hand protection apparatus to a person's hand.

FIGS. 3, 4, 5, 6 and 7 illustrate the steps for attaching hand protection apparatus 10 to a person's hand. As previously explained, it is helpful (although not necessarily required) for tears 123 to be formed prior to attaching hand protection apparatus 10 to a person's hand. As a first step, a person inserts their fingers through finger openings 110. In one exemplary embodiment, a user may insert multiple fingers through one finger opening 110 (when the number of fingers being inserted are greater than the number of finger openings present). Alternatively, when a plurality of finger openings are present (i.e. one finger opening for each finger), a user may insert each finger in a respective finger opening. In the exemplary embodiment illustrated in FIG. 2B, multiple finger openings 110A, B, and C are included. Thus, in the exemplary embodiment illustrated in FIG. 3, middle finger 401 is inserted into finger opening 110C, ring finger 402 is inserted into finger opening 110*b*, and pinky finger 403 is inserted into finger opening 110A. Also, as shown in FIG. 3, fingers 401, 402 and 403 are inserted into finger openings 110 so that fingers 401, 402, and 403 extend above flexible sheet top 101 while backing layer 300 is shown below flexible sheet top 101.

Also, as shown in FIG. 3, a person's right hand has been inserted into hand protection apparatus 10. It is understood that as an alternative, a person's left-hand could be inserted into hand protection apparatus 10. In such an example, an exemplary embodiment of the invention may be practiced with a left hand such that basically appears as a mirror image of the right hand that is illustrated herewith. It is also understood that while an exemplary embodiment has been illustrated with regard to a single hand, in a preferred embodiment of the present invention, a respective hand protection apparatus is applied to each of a user's hands—both left hand and right hand.

In the example illustrated in FIG. 3, first end portion 152 of flexible sheet 100 is extending substantially perpendicularly from fingers 401, 402, and 403. Also, middle portion 154 is also extending substantially perpendicularly from fingers 401, 402, and 403, but opposite to first end portion 152. In addition, in the illustration shown in FIG. 3, backing layer 300 is desirably still attached to flexible sheet 100.

Figure 4:
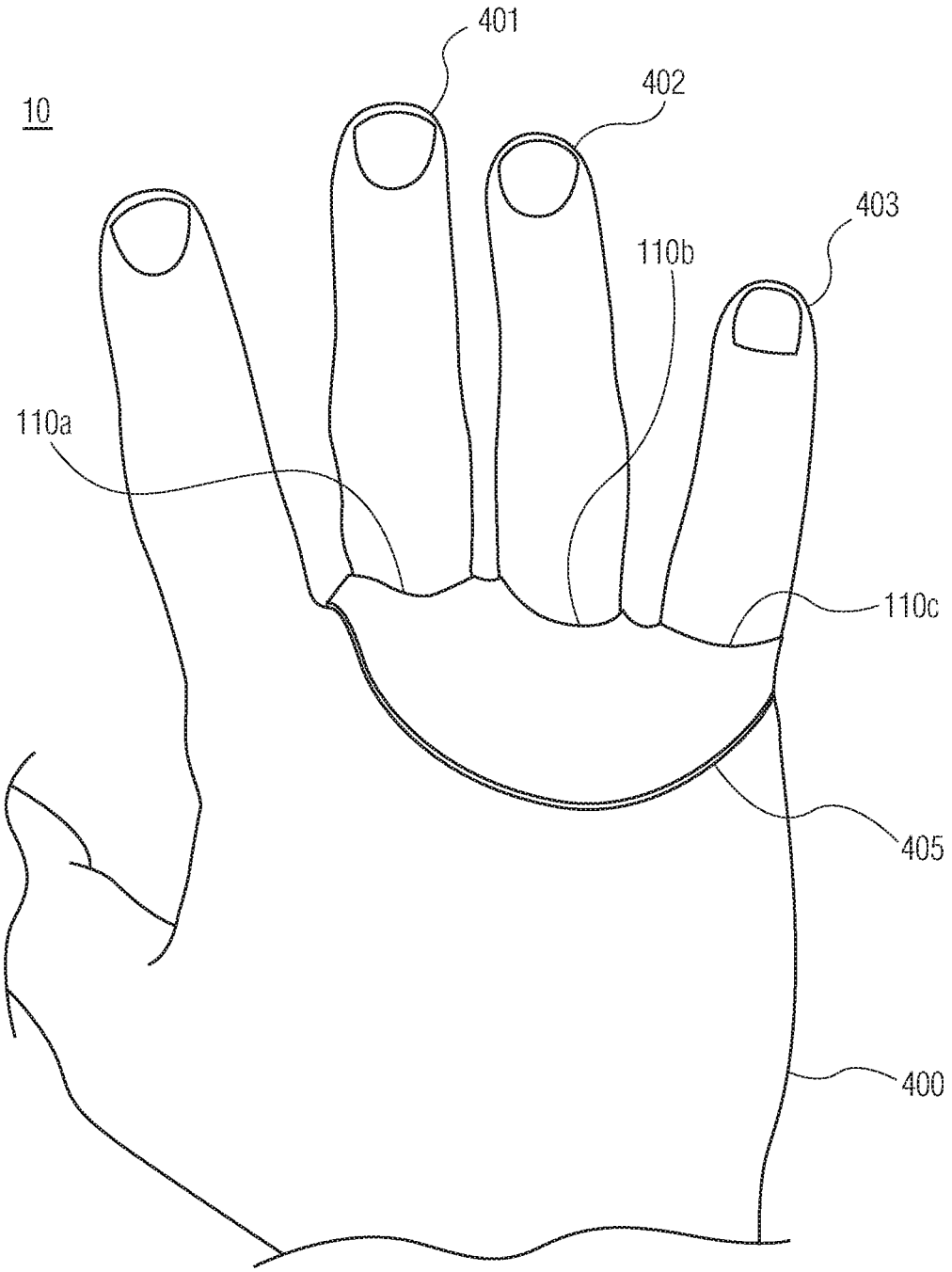
FIG. 4 is a diagram of a further exemplary step that is performed to attach a hand protection apparatus to a person's hand.

FIG. 4 illustrates the next step of attaching flexible sheet 100 to a person's hands. First, the portion of backing layer 300 directly underneath first end portion 152 is removed. The removal process is typically accomplished by simply peeling backing layer 300 off of flexible sheet bottom 102 in order to expose adhesive material 200. The process of removing a portion of backing layer 300 which is directly underneath first end portion 152 may be facilitated by the inclusion of tears 123 shown in FIG. 2B. In this manner, the portion of backing layer 300 that is directly beneath first end portion 152 is removed while the portion of backing layer 300 that is not directly under first end portion 152 remains adhered to flexible sheet bottom 102.

Once a portion of backing layer 300 that is directly beneath first end portion 152 has been removed, first end portion 152 is folded downwards so that it adheres to hands top 405. This configuration is shown in FIG. 4. Thus, in the configuration shown in FIG. 4, first end portion 152 of flexible sheet 100 is attached to hand top 405, but middle portion 154 of flexible sheet 100 is not yet attached to any portion of hand 400.

Figure 5:
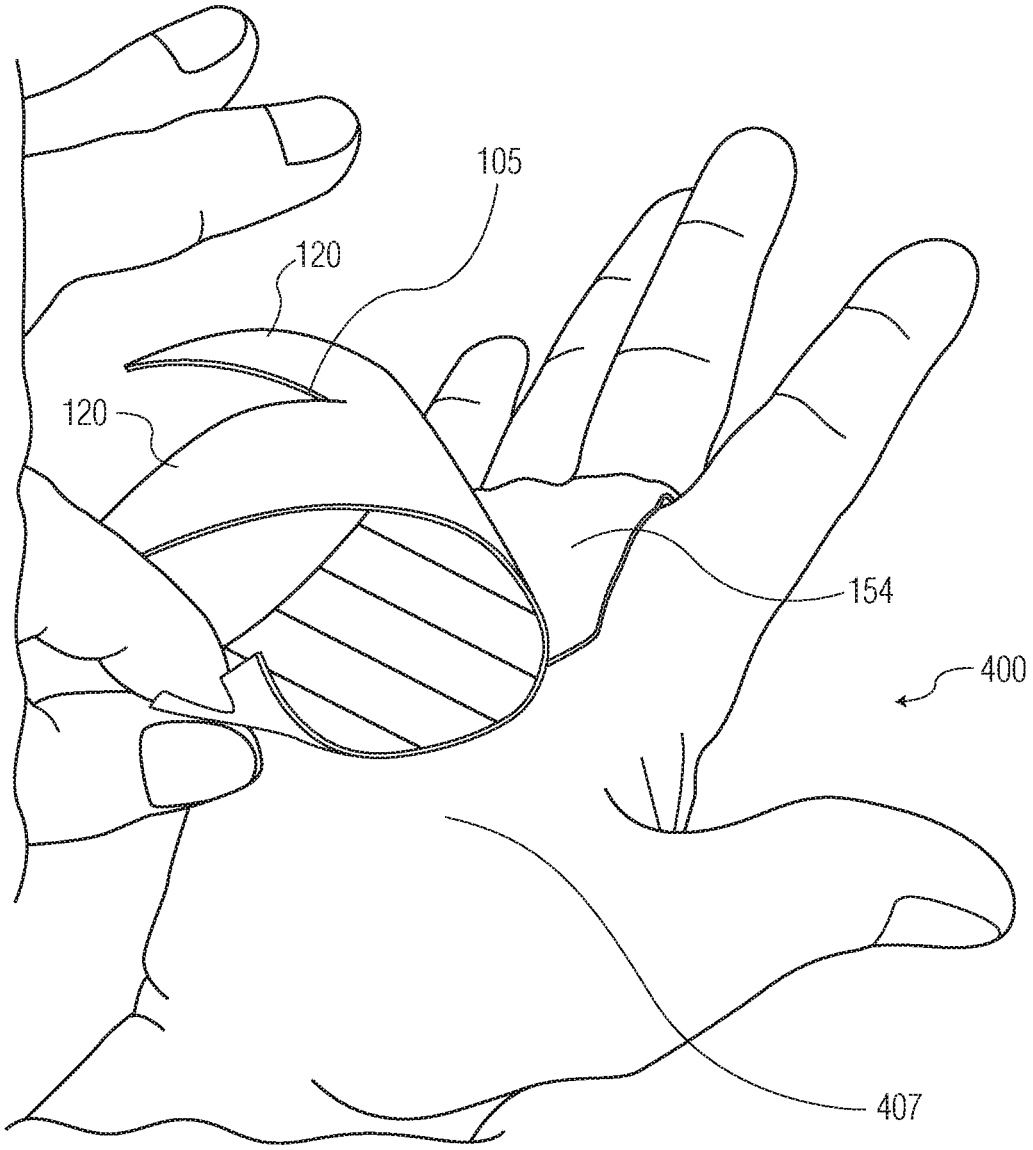
FIG. 5 illustrates yet another exemplary step for attaching an exemplary hand protection apparatus to a person's hand.

FIG. 5 illustrates the next step for attaching flexible sheet 100 to hand 400. In particular, in the step shown in FIG. 5, middle portion 154 is in the process of being attached to hand palm 407. Also, in the step shown in FIG. 5, flexible sheet top 101 has desirably already been attached to hand top 405. Thus, as shown in FIG. 5, the portion of backing layer 300 that is directly below middle portion 154 is being removed, preferably in increments. For example, while the person is extending their palm, backing layer 300 may slowly be removed, (an inch at a time, for example) while the exposed portion of flexible sheet bottom 102 is pressed against palm 407. Flexible sheet 100 is desirably not stretched as middle portion 154 is adhered to hand palm 407. Middle portion 154 is pressed against hand palm 407 until separation 105 is reached. At this time, anchors 120 have not yet been attached to hand 400.

Figure 6:
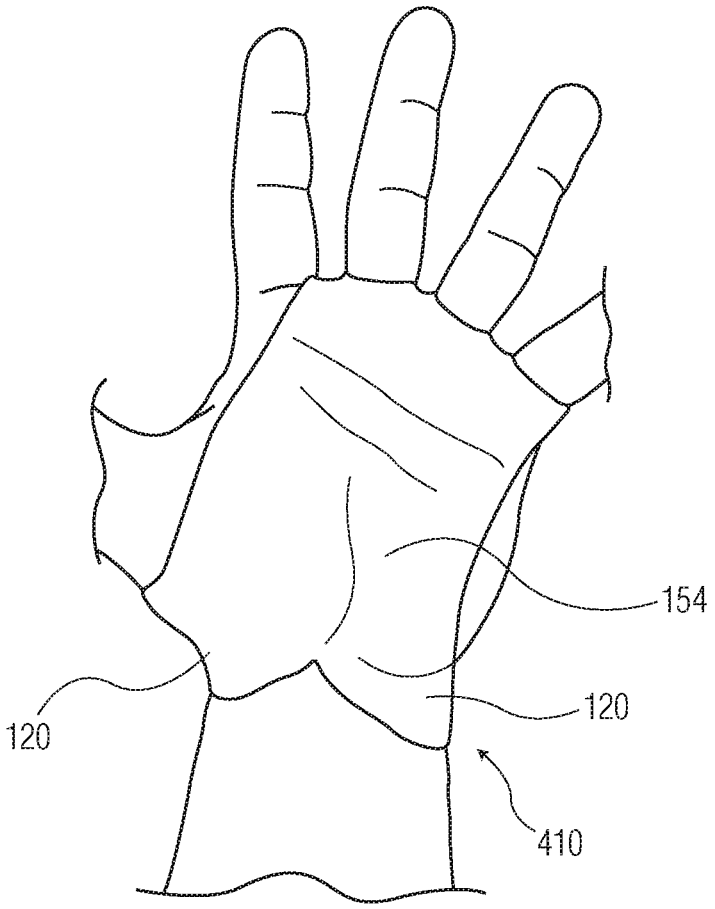
FIG. 6 illustrates yet a further exemplary step of attaching an exemplary hand protection apparatus to a person's hand.
Figure 7:
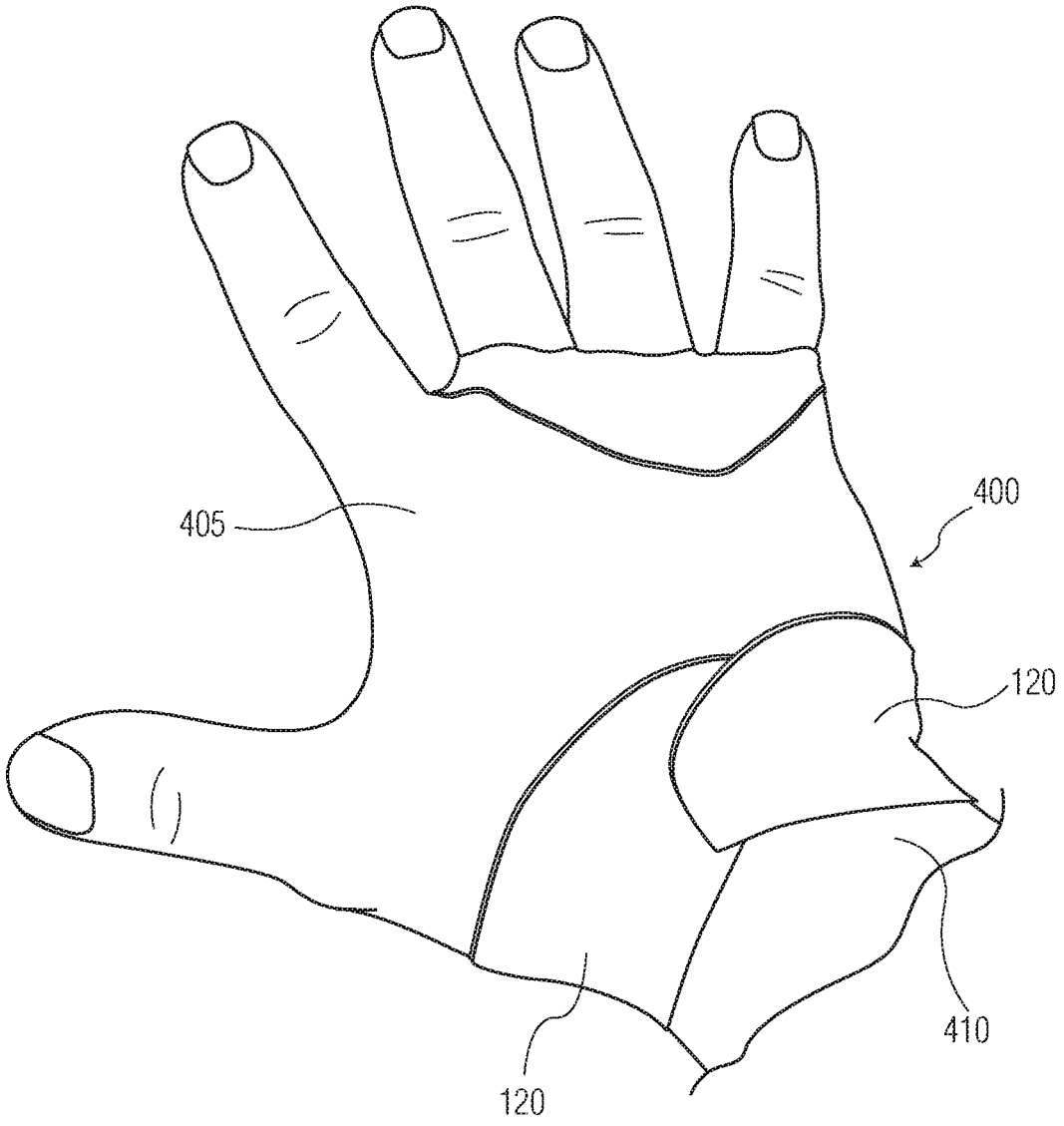
FIG. 7 illustrates yet a further exemplary step for attaching an exemplary hand protection apparatus to a person's hand.

As further shown in FIG. 6, middle portion 154 has been attached to hand palm 407. Next, anchors 120 are attached about wrist 410 and to the side of hand 400 where hand top 405 is located. This is illustrated in FIG. 7. As shown in FIG. 7, anchors 120 have protruded from the side of the hand where hand palm 407 is located; anchors 120 are then wrapped around wrist 410 on the side of the hand where hand top 405 may be found. In one exemplary embodiment, anchors 120 may overlap as shown in FIG. 7.

In a further exemplary embodiment of the present invention, additional tape is wrapped around wrist 410 after anchors 120 have been applied to wrist 410. The additional tape, although optional, may be desirable to strengthen the adherence of flexible sheet 100 to hand 400. Strengthening the adherence may be desirable, for example, during competition or during a physical workout with a significantly high level of volume. As an alternative to additional tape, a wrist wrap (for example made of cotton) may be placed around wrist 410.

Figure 8:
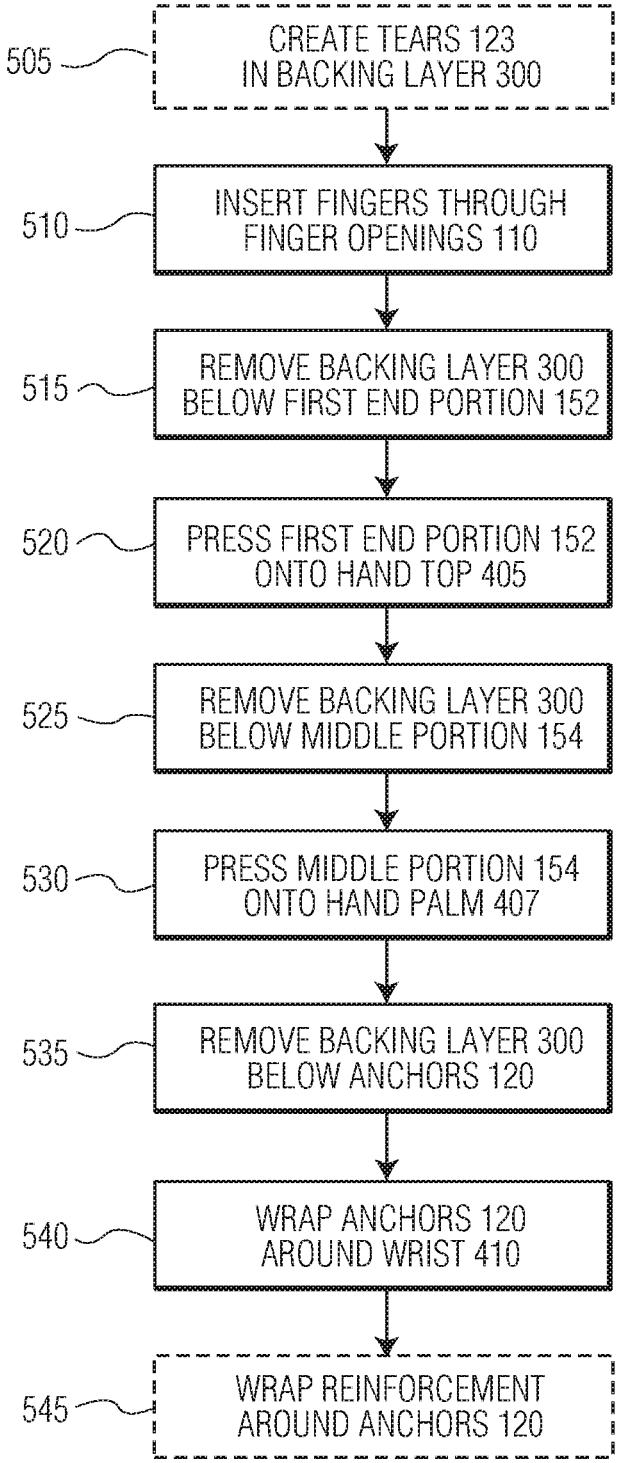
FIG. 8 is a flowchart diagram which illustrates exemplary steps for attaching an exemplary hand protection apparatus to a person's hand.

FIG. 8 is a flowchart diagram which illustrates a method in accordance with an exemplary embodiment of the present invention. At optional step 505, tears 123 are created in backing layer 300. As previously explained, tears 123 may optionally be created during the manufacturing process of manufacturing hand protection apparatus 10. In a further exemplary embodiment of the present invention, tears 123 are not created until after a person's fingers are inserted into the finger openings 110 of hand protection apparatus 10. At step 510, a person inserts the fingers of their hand through finger openings 110. As previously explained, and in one exemplary embodiment of the present invention, multiple fingers are inserted into a hole. In such an exemplary embodiment, there may be only one finger opening 110 or there may be multiple finger openings 110. In a further exemplary embodiment of the present invention, each finger is inserted into a respective finger opening 110 in hand protection apparatus 10. At step 515, the portion of backing layer 300 that is directly below first end portion 152 is removed from hand protection apparatus 10 in order to expose adhesive material 200 that is attached to flexible sheet bottom 102. At step 520, first end portion 152 of flexible sheet 100 is pressed onto hands top 405. At step 425, the portion of backing layer 300 that is directly below middle portion 154 is removed from hand protection apparatus 10. As a result of this step, adhesive material 200 that is attached to flexible sheet 100 below middle portion 154 is exposed. At step 530, middle portion 154 is pressed onto hand palm 407. Steps 425 and 430 may alternate. Thus, for example, one inch of backing layer 300 may be removed from flexible sheet 100, the portion of flexible sheet 100 from which backing layer 300 has been removed is pressed onto hand palm 407, a further inch of backing layer 300 is removed from flexible sheet 100, the further portion of flexible sheet 100 from which backing layer 300 has been removed is pressed onto hand palm 407, etc. Step 530 may be performed until middle portion 154 is attached to the user's hand. Thus, for example, the attachment of flexible sheet 100 to a person's hand may transition to step 540 when middle portion 154 has been attached to hand palm 407 above separation 105. At step 540, anchors 120 are wrapped around wrist 410 of the user's hands. At optional step 545, further reinforcement is wrapped around anchors 120 (such as additional tape, an expandable band, etc.).

Hand protection apparatus as described herein may refer to flexible sheet 100 and adhesive material 200 with or without backing layer 300.

While the present invention has been described herein with reference to exemplary embodiments, it should be understood that the invention is not limited thereto. Those skilled in the art with an access to the teachings herein will recognize additional modifications, applications, and embodiments within the scope thereof and additional fields in which the invention would be useful.

The present application has set forth one or more but not all exemplary embodiments of the present invention as contemplated by the inventor(s), and thus, is not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

The invention claimed is:

1. Apparatus for protection of a hand having a wrist, a plurality of fingers and a plurality of knuckles, comprising:

a flexible sheet having a continuous top side and a bottom flat side opposite the top side, said flexible sheet extending from a first edge to a second edge along a length thereof, said flexible sheet having a plurality of sections including a first section adjacent to said first edge, a second section adjacent to said second edge; and a third section between said first section and said second section, so that along said length from said first edge to said second edge said plurality of sections are ordered said first section, said third section, and said second section;

an adhesive material on said bottom flat side of said flexible sheet;

a backing layer on said adhesive material and subsequently removed;

said first section includes a flat area that has at least one finger opening planar with said flat area and located along a width of said flexible sheet, said width perpendicular to said length, said length from said first edge to said second edge greater than said width, said third section between said at least one finger opening and said second section;

said at least one opening is encircled by said flexible sheet in said first section so that, when at least one of said fingers are inserted into said at least one opening, said at least one of said fingers are encircled by said flexible sheet, topmost edges of said openings are between said first edge and bottom edges of said openings, and said flexible sheet includes a flexible sheet portion, above said topmost edges of said openings and below said first edge, that covers said knuckles after removal of at least a portion of said backing layer, said topmost edges above said third section;

length of said first section is less than combined length of said second section and said third section.

2. Apparatus according to claim 1, wherein said length is longer than a width of said flexible sheet.

3. A method for hand protecting of a hand having a wrist, a plurality of fingers and a plurality of knuckles, said method comprising the steps of: inserting fingers of a hand through at least one finger opening in a flexible sheet having a continuous top side and a bottom flat side opposite the top side, said flexible sheet extending from a first edge to a second edge along a length thereof, said flexible sheet having a plurality of sections including a first section adjacent to said first edge, a second section adjacent to said second edge; and a third section between said first section and said second section, so that along said length from said first edge to said second edge said plurality of sections are ordered said first section, said third section, and said second section;

an adhesive material on said bottom flat side of said flexible sheet;

a backing layer on said adhesive material that is subsequently removed;

said first section includes a flat area that has said at least one finger opening planar with said flat area and located along a width of said flexible sheet, said width perpendicular to said length, said length from said first edge to said second edge greater than said width, said third section between said at least one finger opening and said second section;

said at least one opening is encircled by said flexible sheet in said first section so that, when at least one of said fingers are inserted into said at least one opening, said at least one of said fingers are encircled by said flexible sheet, topmost edges of said openings are between said first edge and bottom edges of said openings, and said flexible sheet includes a flexible sheet portion, above said topmost edges of said openings and below said first edge, that covers said knuckles after removal of at least a portion of said backing layer, said topmost edges above said third section;

length of said first section is less than combined length of said second section and said third section.;

pressing said third section onto a palm of said hand; and pressing said flexible sheet portion onto said knuckles to cover said knuckles.

4. A method according to claim 3, wherein said length is longer than a width of said flexible sheet.

5. Apparatus according to claim 1, wherein said flexible sheet portion is a continuous flap above a plurality of openings that include said opening.

6. Apparatus according to claim 5, wherein combined width of said openings is less than width of said flexible sheet.

7. Apparatus according to claim 1, wherein the flexible sheet stretches to increase size of said at least one opening.

8. Method according to claim 3, wherein said flexible sheet portion is a continuous flap above a plurality of openings along said width that include said opening.

9. Method according to claim 8, wherein combined width of said openings is less than width of said flexible sheet.

10. Method according to claim 3, wherein the flexible sheet stretches to increase size of said at least one opening.

11. Apparatus according to claim 1, wherein said at least one finger opening is included in a plurality of finger openings arranged in sequence along said width, and each of said openings are encircled by said flexible sheet.

12. A method according to claim 3, wherein said at least one finger opening is included in a plurality of finger openings arranged in sequence along said width, and each of said openings are encircled by said flexible sheet.

13. Apparatus according to claim 1, further comprising a member that wraps around the wrist.

14. A method according to claim 3, further comprising the step of wrapping a member around the wrist.

* * * * *